US008904840B2

(12) United States Patent
Ooi et al.

(10) Patent No.: US 8,904,840 B2
(45) Date of Patent: Dec. 9, 2014

(54) METHOD FOR MANUFACTURING COATING ROD

(75) Inventors: Yuuki Ooi, Shizuoka (JP); Atsushi Ooshima, Shizuoka (JP); Nobuyuki Sone, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 595 days.

(21) Appl. No.: 13/207,580

(22) Filed: Aug. 11, 2011

(65) Prior Publication Data

US 2012/0049405 A1 Mar. 1, 2012

(30) Foreign Application Priority Data

Aug. 30, 2010 (JP) ..... 2010-192751

(51) Int. Cl.

| | |
|---|---|
| ***B21H 3/04*** | (2006.01) |
| ***B21H 7/18*** | (2006.01) |
| ***B05C 11/02*** | (2006.01) |
| *B21B 19/12* | (2006.01) |
| *B21D 3/02* | (2006.01) |
| *B21B 27/00* | (2006.01) |
| *B21D 15/00* | (2006.01) |
| *B21J 15/12* | (2006.01) |
| *B05C 1/08* | (2006.01) |

(52) U.S. Cl.

CPC ..... *B21H 7/182* (2013.01); *B05C 1/0808* (2013.01); *B05C 1/0826* (2013.01); *B05C 11/025* (2013.01)

USPC ..... 72/103; 72/98; 72/118; 72/102; 72/114

(58) Field of Classification Search

CPC ..... B21D 22/201; B21D 3/04; B21D 17/04; B21D 51/50; B21C 23/22; B21B 19/02; B21B 31/203; B21B 31/18; B21B 5/00; B21H 5/02; B21H 3/048; B21H 1/18; B24B 39/045

USPC ..... 72/46, 47, 95, 98, 100, 101, 102, 103, 72/246, 247, 104, 108, 110, 111, 114, 118, 72/119, 469, 256; 470/10

See application file for complete search history.

(56) References Cited

U.S. PATENT DOCUMENTS 412,082 A * 10/1889 Forsyth ..... 72/100

(Continued)

FOREIGN PATENT DOCUMENTS

| | | |
|---|---|---|
| GB | 443541 A | 3/1936 |
| JP | 2-224840 A | 9/1990 |

(Continued)

OTHER PUBLICATIONS

Japanese Office Action dated Dec. 18, 2013, issued in corresponding Japanese Patent Application No. 2010-192751.

Japanese Office Action dated Aug. 18, 2014, issued in corresponding Japanese Patent Application No. 2010-192751.

*Primary Examiner* — Shelly Self

*Assistant Examiner* — Lawrence Averick

(74) *Attorney, Agent, or Firm* — Birch, Stewart, Kolasch & Birch, LLP

(57) ABSTRACT

A method for manufacturing a coating rod, comprising the steps of preparing a rod material, disposing a pair of form rolling dies having a plurality of helical convex threads, so that the closure angle of a main axis of each of the form rolling dies in the horizontal direction of the main axis is substantially 0.25° or larger but not larger than 0.35° with respect to an axial direction of the rod material, and form-rolling the rod material by feeding the rod material along the axial direction thereof and rotating the pair of form rolling dies around the main axes thereof, while clamping the rod material with the pair of form rolling dies.

8 Claims, 6 Drawing Sheets

(56) References Cited

U.S. PATENT DOCUMENTS

| | | | | |
|---|---|---|---|---|
| 2,243,608 | A * | 5/1941 | Schaurte | 72/47 |
| 3,058,196 | A * | 10/1962 | Bour | 72/78 |
| 6,708,544 | B2 * | 3/2004 | Sannomiya | 72/103 |
| 7,470,327 | B2 * | 12/2008 | Ooshima et al. | 118/123 |
| 2005/0109272 | A1 | 5/2005 | Ooshima et al. | |

FOREIGN PATENT DOCUMENTS

| | | | |
|---|---|---|---|
| JP | 3-189039 | A | 8/1991 |
| JP | 2000-210746 | A | 8/2000 |
| JP | 2004-89825 | A | 3/2004 |
| JP | 2005-111299 | A | 4/2005 |
| JP | 4460257 | B2 | 5/2010 |

* cited by examiner

METHOD FOR MANUFACTURING COATING ROD

BACKGROUND OF THE INVENTION

1. Field of the Invention

The present invention relates to a method for manufacturing a coating rod for coating various types of liquid materials (coating liquids) on a continuously traveling sheet-like or belt-like substrate (hereinafter referred to as a web), such as a thin metal sheet, paper or film, and smoothing the liquid material after coating.

2. Description of the Related Art

As coating apparatuses for coating various types of coating liquids on a web, such as a thin metal sheet, paper, or a plastic film, there is known a variety of apparatus, including a roll coater, an air knife coater, a coater using dies, and a rod coater.

Of these coating apparatuses, the rod coater is a simple coating apparatus capable of coating various types of coating liquids on various types of webs, and therefore, is widely utilized. The rod coater includes a type which scrapes off excess amounts of coating liquid coated on the web with a coating rod (also referred to as a coating bar), and a type which performs both coating on the web and adjustment of the amount of coating liquid with one coating rod. In either type of rod coater, a multitude of grooves is formed on a surface of the coating rod in the circumferential direction thereof. By adjusting the depth and width of these grooves, the amount of coating liquid coated on the web and the amount of coating liquid to be scraped off are adjusted.

As a method for forming grooves on the surface of the coating rod, there is known a method of groove formation by means of form rolling. In this method, a rod material is held between two form rolling dies in which grooves are formed. The rod material is advanced in the axial direction thereof, while rotating the form rolling dies, thereby forming grooves on a surface of the rod material. This method has the problem, however, that if the depth of grooves formed on the rod material is non-uniform due to uneven form rolling, the highest portion of the rod material locally has contact with the web, thus producing scratches.

In order to solve this problem, Japanese Patent No. 4460257 discloses a method for grinding surfaces (ridges) of a coating rod after form rolling, so that 99.5% or more of the cross sections of ridges orthogonal to the axial direction of the coating rod are flush with one another.

In the method disclosed in Japanese Patent No. 4460257, however, ridges are ground after form rolling out of consideration of the shape of valleys. Accordingly, the cross-sectional area of each groove may change due to grinding, thus causing uneven coating in some cases.

The present invention has been accomplished in view of such circumstances, and an object of the invention is to provide a method for manufacturing a coating rod capable of eliminating scratches and uneven coating on a web.

SUMMARY OF THE INVENTION

According to one aspect of the present invention, a method for manufacturing a coating rod includes the steps of preparing a rod material; disposing a pair of form rolling dies having a plurality of helical convex threads, so that the closure angle of a main axis of each of the form rolling dies in the horizontal direction of the main axis is substantially 0.25° or larger but not larger than 0.35° with respect to an axial direction of the rod material; and form-rolling the rod material by feeding the rod material along the axial direction thereof and rotating the pair of form rolling dies around the main axes thereof, while clamping the rod material with the pair of form rolling dies.

According to another aspect of the present invention, the manufacturing method preferably further includes a step of grinding a surface of the rod material after the form rolling step.

According to yet another aspect of the present invention, the rod material is preferably held by a base in the form rolling step.

According to still another aspect of the present invention, the manufacturing method preferably includes adjusting a distance between the pair of form rolling dies and a heightwise spacing between each of the main axes of the form rolling dies and a central axis of the rod material.

According to the present invention, there can be obtained a coating rod capable of preventing scratches and uneven coating on a web.

DETAILED DESCRIPTION OF THE PREFERRED EMBODIMENTS

Hereinafter, preferred embodiments of the present invention will be described according to the accompanying drawings. The present invention will be described according to the following preferred embodiments but is capable of changes in many ways without departing from the scope of the present invention. Thus, embodiments other than the preferred embodiments may be utilized. Accordingly, it is to be understood that all the changes within the scope of the present invention are included in the appended claims. In addition, in the present specification, a numeric range represented by the tilde (~) sign refers to a range inclusive of numeric values mentioned before and after the tilde (~) sign.

Figure 1:
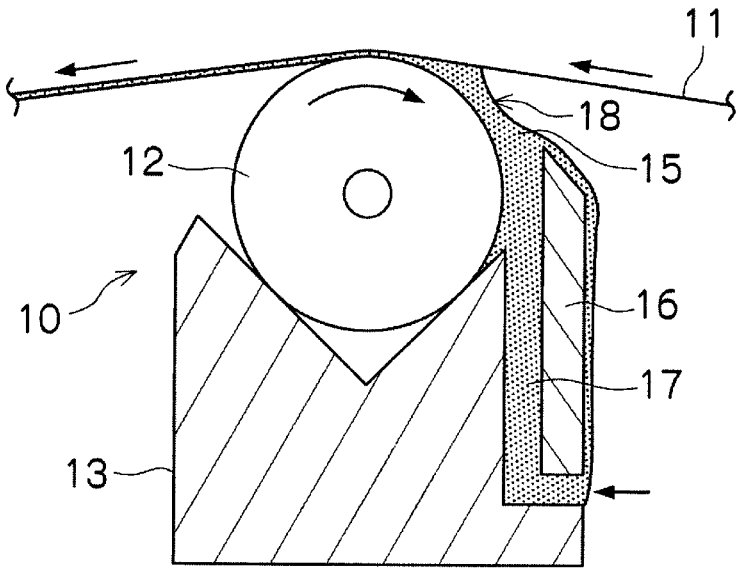
FIG. 1 is a schematic view illustrating a rod coater provided with a coating rod.

FIG. 1 illustrates a rod coater provided with a coating rod. A rod coater 10 is provided with a coating rod 12, a rod holding block 13 for rotatably holding the coating rod 12, and a weir member 16 adjacent to the rod holding block 13. A coating liquid 15 is supplied to a coating liquid feed passage 17 formed by the rod holding block 13 and the weir member 16. The coating rod 12 is disposed in the width direction of a web 11, while being placed in contact with the traveling web 11. In the rod coater 10, the one coating rod 12 performs both supply of a coating liquid to the web 11 and adjustment of the amount of coating liquid. The coating rod 12 may be rotated in the same direction as the traveling direction of the web, may be placed in a state of rest, or may be rotated in a direction opposite to the traveling direction.

Now, a description will be given of a coating method using the rod coater 10. A liquid pool 18 of a coating liquid 15 is formed in a zone of contact between the continuously traveling web 11 and the coating rod 12. The coating liquid 15 of the liquid pool 18 is metrically coated on the web 11 by the rotating coating rod 12.

Figure 2:
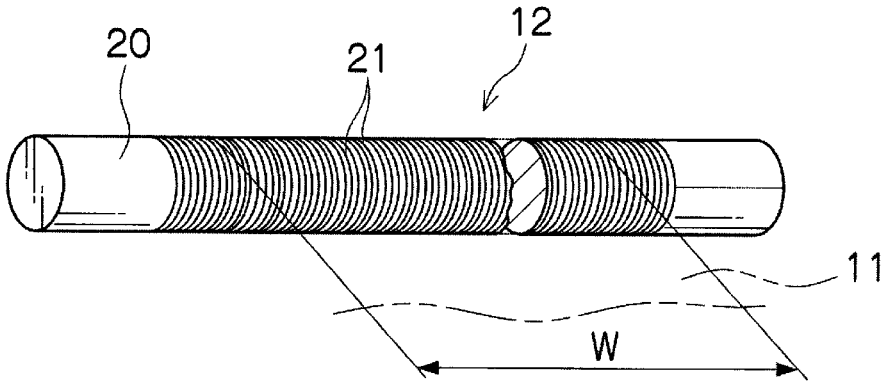
FIG. 2 is a perspective view illustrating part of the coating rod.

FIG. 2 is a schematic configurational view of a coating rod. As illustrated in FIG. 2, a coating rod 12 is formed of a columnar rod material 20. The rod material 20 is made of such a material as SUS (Steel Use Stainless). Grooves (concave portions 21) are formed across a substantially overall length of the rod material 20 in the circumferential direction of a circumferential surface of the rod material 20. The width across which the grooves 21 are formed is larger than a coating width W. The amount of coating liquid is adjusted by the depth, width and pitch of the grooves (concave portions 21).

Figure 3:
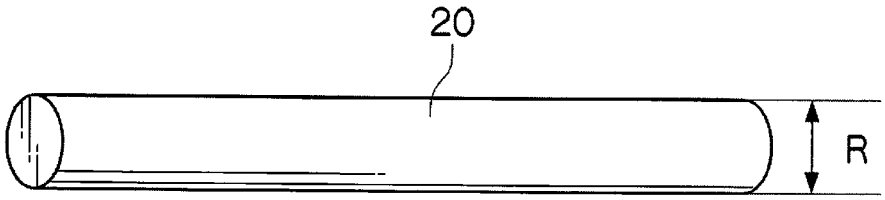
FIG. 3 is a perspective view illustrating a rod material.

Next, a description will be given of a method for manufacturing a coating rod. As illustrated in FIG. 3, a rod material 20 for constituting a coating rod is prepared. The rod material 20 is made of, for example, SUS and has a columnar shape of 3 to 70 mm in outer diameter (R).

Figure 4:
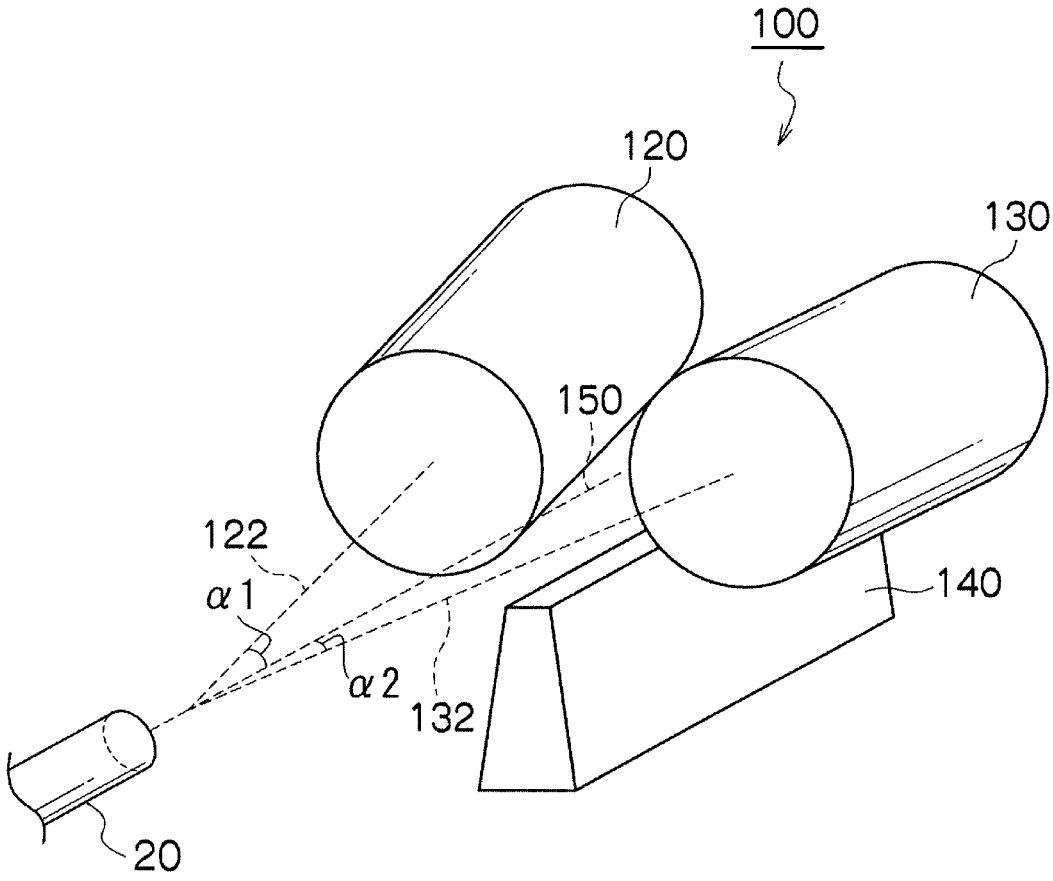
FIG. 4 is a schematic view illustrating a form rolling apparatus.
Figure 5:
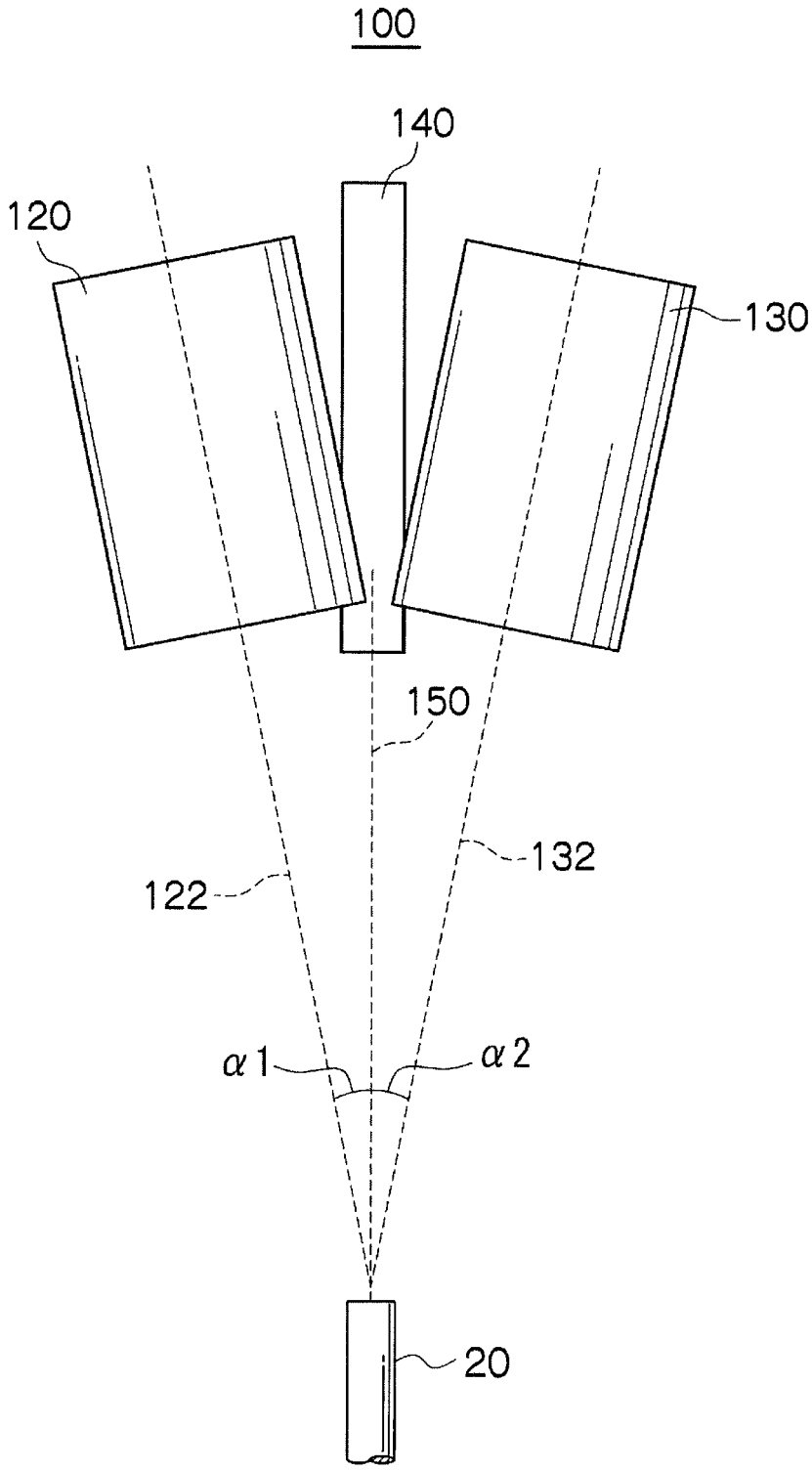
FIG. 5 is a top view of the form rolling apparatus.

FIG. 4 is a schematic configurational view illustrating a form rolling apparatus for forming grooves on a rod material 20. FIG. 5 is a top view of the form rolling apparatus. A form rolling apparatus 100 is provided with a first form rolling die 120 and a second form rolling die 130 for clamping and form-rolling a rod material 20 and a base 140 for holding the rod material 20. The first form rolling die 120 and the second form rolling die 130 have a substantially columnar shape and rotate with main axes 122 and 132 of the respective form rolling dies 120 and 130 as the centers of rotation. The length of each main axis is generally 100 to 500 mm. In order to form grooves on the rod material 20, the first form rolling die 120 and the second form rolling die 130 have outer circumferential surfaces formed of a plurality of helical convex threads with the reverse geometry of the grooves. Bevel leads, parallel portions, and relief portions are formed in the first form rolling die 120 and the second form rolling die 130 from an entry side toward an exit side of the rod material 20. In each bevel lead, the outer diameter of each of the form rolling dies 120 and 130 increases gradually from one end toward the parallel portion of the form rolling die. In each parallel portion, the outer diameter of each form rolling die is substantially the same. In each relief portion, the outer diameter of the form rolling die gradually decreases from the parallel portion toward the other end of the form rolling die.

The first form rolling die 120 is disposed, so that a closure angle $\alpha 1$ of the main axis 122 in the horizontal direction thereof is substantially 0.25° or larger but not larger than 0.35° with respect to an axial direction 150 of the rod material 20. As with the first form rolling die 120, the second form rolling die 130 is disposed, so that a closure angle $\alpha 2$ of the main axis 132 in the horizontal direction thereof is substantially 0.25° or larger but not larger than 0.35° with respect to the axial direction 150 of the rod material 20. The closure angle $\alpha 1$ and the closure angle $\alpha 2$ are preferably the same. The closure angle of the main axis of each form rolling die in the horizontal direction thereof with respect to the axial direction of the rod material 20 refers to an angle formed on the entry side of the rod material 20 by (1) the main axes 122 and 132 and (2) a straight line parallel to the axial direction 150 of the rod material 20 and substantially level with the main axes 122 and 132.

Figure 6A:
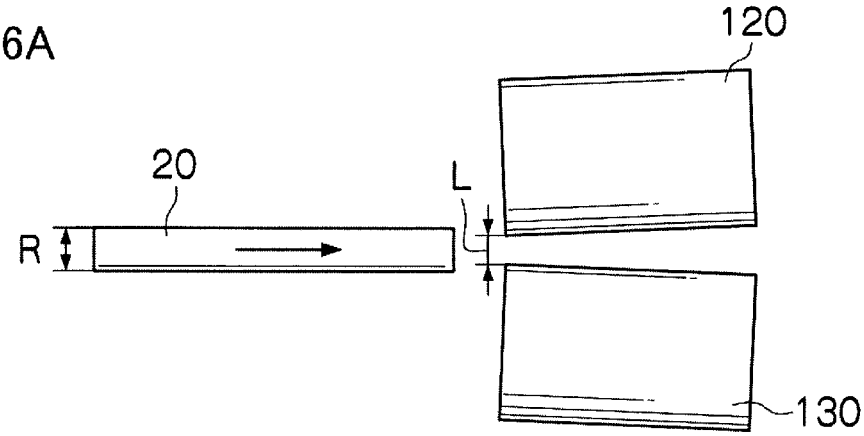
FIGS. 6A to 6C are schematic views illustrating a method for manufacturing a coating rod.

Next, a method for manufacturing a coating rod will be described with reference to FIGS. 6A, 6B and 6C. As illustrated in FIG. 6A, the first form rolling die 120 and the second form rolling die 130 are disposed, so that the closure angle of a main axis of each form rolling die with respect to the axial direction thereof is 0.25° or larger but not larger than 0.35°. An entry-side distance L between the first form rolling die 120 and the second form rolling die 130 is smaller than an outer diameter R of the rod material 20. The first form rolling die 120 and the second form rolling die 130 are rotated by an unillustrated driving apparatus at a rotational speed of 5 to 100 rpm. The rod material 20 advances while rotating in synchronization with the rotation of the form rolling dies.

Figure 6B:
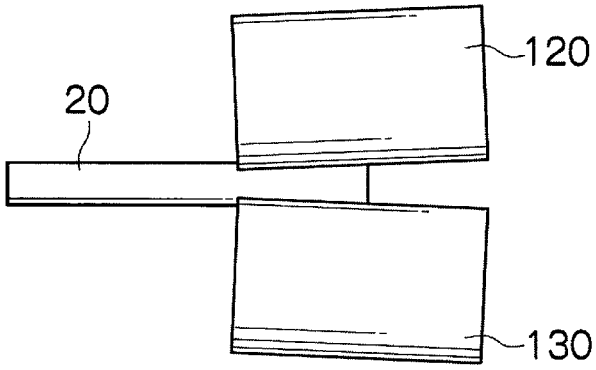

As illustrated in FIG. 6B, the rod material 20 is fed in between the first form rolling die 120 and the second form rolling die 130. The rod material 20 is clamped by the first form rolling die 120 and the second form rolling die 130. During the rotation of the dies 120 and 130, the main axes thereof are held by means of hydraulic pressure or by other means. The amount of hydraulic pressure is 0.6 to 100 tons.

Figure 6C:
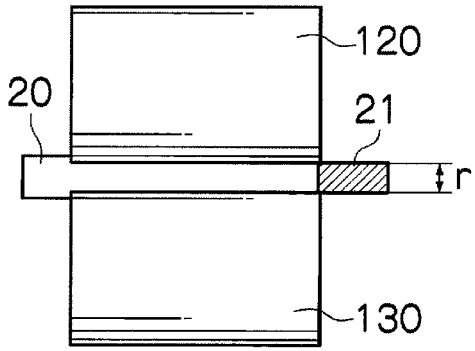

As illustrated in FIG. 6C, the rod material 20 passes through between the first form rolling die 120 and the second form rolling die 130. Consequently, grooves are formed on the outer circumferential surface of the rod material 20 by the first form rolling die 120 and the second form rolling die 130. By setting the closure angle $\alpha 1$ and the closure angle $\alpha 2$ to substantially 0.25° or larger but not larger than 0.35°, the first form rolling die 120 and the second form rolling die 130 are substantially parallelized with each other while the rod material 20 is being form-rolled. Since the first form rolling die 120 and the second form rolling die 130 are substantially parallelized with each other, it is possible to prevent uneven rolling. This is due to the outer diameter of the rod material 20 being different between before and after form rolling since a form rolling process involves plastic deformation. That is, the outer diameter R of the rod material 20 before form rolling is larger than an outer diameter r of the rod material 20 after form rolling.

Accordingly, if the closure angle is smaller than 0.25°, the rod material 20 pushes the form rolling dies outward at an inlet during actual form rolling. That is, form rolling is performed on the rod material 20 with a pair of form rolling dies 120 and 130 opened at the inlet and closed at an outlet. As a result, form rolling is performed on the rod material 20 only on the outlet side of the form rolling dies 120 and 130.

On the other hand, if the closure angle is larger than 0.35°, the pair of form rolling dies 120 and 130 are closed at the inlet and open at the outlet also during form rolling. Consequently, form rolling is performed on the rod material 20 only on the inlet side of the form rolling dies 120 and 130.

Figure 7:
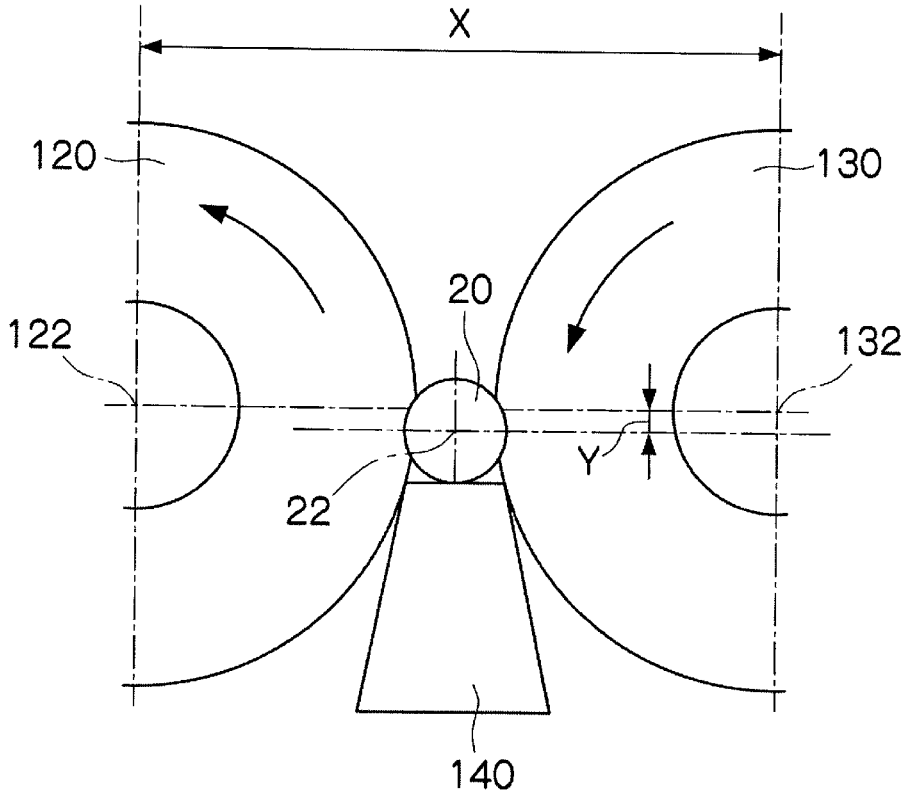
FIG. 7 is a plan view of the form rolling apparatus.

FIG. 7 is a plan view of a form rolling apparatus. In order to adjust the clamping pressure of the rod material 20, adjustments are made to a distance (spacing) X between the first form rolling die 120 and the second form rolling die 130 and to a heightwise distance (spacing) Y between each of the main axes 122 and 132 of the first form rolling die 120 and the second form rolling die 130 and a central axis 22 of the rod material 20. By adjusting the distance X, adjustments are made to a push-in amount (form rolling pressure) applied to the rod material 20 by the pair of form rolling dies 120 and 130. By adjusting the distance Y, adjustments are made to the height of a workpiece. Here, the height of a workpiece refers to a vertical position thereof with reference to the main axes 122 and 132 of each dies 120 and 130.

Figure 8:
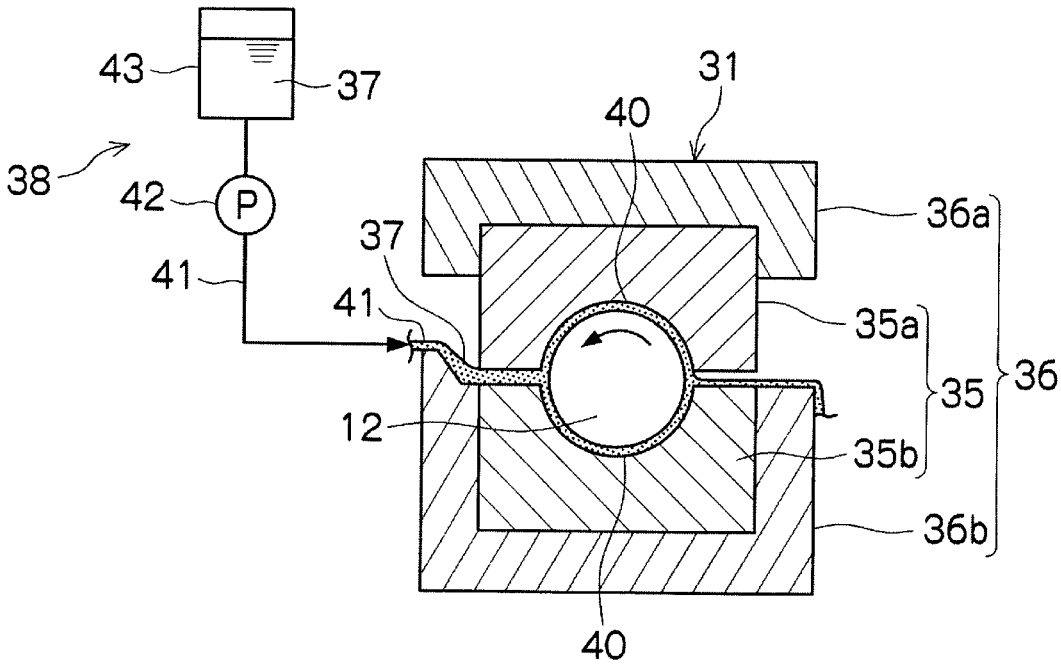
FIG. 8 is a cross-sectional view of a grinding apparatus.

A surface of a form-rolled coating rod can be ground using a grinding apparatus. Note that a plating process or any other surface-treatment process may be adopted after form rolling and before surface grinding. Plating refers to chromium plating, nickel plating, or any other plating, including composite metal plating and diamond-like carbon treatment. This plating is carried out using a chemical vapor-phase growth method or a sputtering method. FIG. 8 is a cross-sectional view of the grinding apparatus. The grinding apparatus is provided with a grinding unit 31, a rod rotating part (not shown in FIG. 8), and a rod shift part (not shown in FIG. 8). The grinding unit 31 is provided with a multitude of lappers 35 for holding the coating rod 12, so as to clamp the coating rod 12 from above and below, a hold holding base 36 for holding these lappers 35, and an abrasive feed unit 38 for feeding an abrasive 37 to a contact surface between the lappers 35 and the coating rod 12.

Each of the lappers 35 is divided into two sections in the vertical direction thereof, thus being composed of an upper lapper body 35*a* and a lower lapper body 35*b*. The lappers 35 are disposed in large numbers in the axial direction of the coating rod 12 and located within a holding base 36. A grinding surface 40 including an inner circumferential surface having almost the same diameter as the diameter of the coating rod 12 is formed in the lapper bodies 35*a* and 35*b*. Each lapper 35 is, for example, 80 mm in length in the axial direction of the coating rod and, for example, 25 units of such lappers are disposed in an array. The number of lappers 35 is determined according to the coating width of the coating rod 12 or the length of a convex area in the axial direction of the coating rod.

Each upper lapper body 35*a* is held by an upper support base 36*a*. The upper lapper body 35*a* is urged by the lapper body's own weight toward the coating rod 12. Each lower lapper body 35*b* is held on a lower support base 36*b*. Each lapper 35 is made of such a material as a resinous compound, in addition to cast iron or copper alloy.

In order to feed the abrasive 37 to the grinding surface 40 of each lapper 35, an abrasive feed unit 38 includes a feed pipe 41 and a pump 42. Thus, the abrasive 37 from the abrasive feed tank 43 is fed onto the grinding surface 40 of the lapper 35. As the abrasive 37, iron oxide, aluminum oxide or pumice, for example, is used.

Now, a grinding method will be described. First, one end of the coating rod 12 is held by a chuck after the coating rod 12 is set on the grinding surface 40 within the lappers 35. Next, the abrasive feed unit 38 is driven to feed the abrasive (lapping agent) 37 to the grinding surface 40 of each lapper 35. Then, the coating rod 12 is put into reciprocal motion in the axial direction of the coating rod 12, while rotating the coating rod 12. Consequently, convex portions of the coating rod 12 are ground so as to be almost flattened out.

EXAMPLES

Hereinafter, specific examples of the present invention will be cited to describe the present invention in further detail. Note however that the present invention is not limited to these examples.

First, a columnar rod material having an outer diameter of 10 mm and a length of 1000 mm and made of SUS304 was prepared. Using a form rolling apparatus, grooves were formed on a rod material, while varying the closure angle α of form rolling dies. Table 1 shows a closure angle, a rod shape, and results of evaluation of coated surfaces with and without surface grinding.

Figure 9:
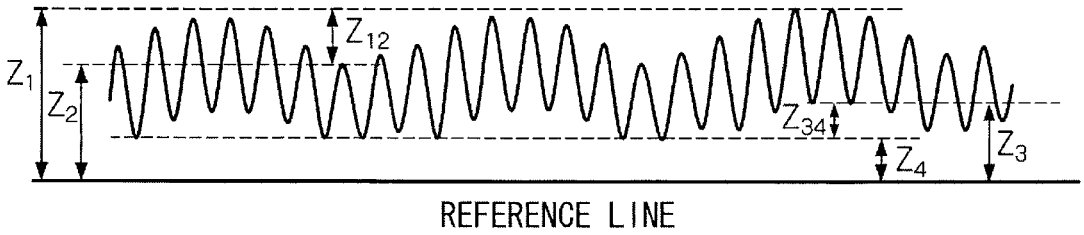
FIG. 9 is an enlarged view of an outer circumferential surface of a coating rod.

Now, evaluation of form rolling unevenness will be described. FIG. 9 is an enlarged view of the outer circumferential surface of a coating rod. First, a determination was made of a maximum value $Z_1$ and a minimum value $Z_2$ of the heights of outer circumferential surface ridges orthogonal to the axial direction of the coating rod. Then, a difference $Z_{12}$ between the maximum value $Z_1$ and the minimum value $Z_2$ was determined. Likewise, a determination was made of a maximum value $Z_3$ and a minimum value $Z_4$ of the heights of outer circumferential surface valleys orthogonal to the axial direction of the coating rod. Then, a difference $Z_{34}$ between the maximum value $Z_3$ and the minimum value $Z_4$ was determined. The value of one of the difference $Z_{12}$ and the difference $Z_{34}$, whichever was larger, was defined as form rolling unevenness Z (μm). A reference line is set by being laid on, for example, a surface plate. In this case, $Z_4=0$.

Evaluation of scratches was conducted by visually observing the surface condition of a coated film, and then visually inspecting a substrate for scratches by separating off the coated film. A case in which both the coated film and the substrate had no scratches was denoted by A, a case in which the substrate had scratches but the coated film had no scratches was denoted by B, and a case in which both the coated film and the substrate had scratches was denoted by C. The evaluation of coating unevenness was conducted by visually observing a surface condition immediately after coating and after the completion of drying. A case in which the surface condition was satisfactory both immediately after coating and after the completion of drying was denoted by A, a case in which the coated film was observed to be uneven immediately after coating but was satisfactory after the completion of drying was denoted by B, and a case in which the coated film was uneven both immediately after coating and after the completion of drying was denoted by C.

TABLE 1

| | Closure angle α (°) | Form rolling unevenness Z [Before grinding] (μm) | Scratch evaluation [Before grinding] | Coating unevenness [Before grinding] | Form rolling unevenness Z [After grinding] (μm) | Scratch evaluation [After grinding] | Coating unevenness [After grinding] |
|---|---|---|---|---|---|---|---|
| Condition 1 | 0.25 | 0.5 | B | A | 0.3 | A | A |
| Condition 2 | 0.30 | 0.3 | A | A | 0.2 | A | A |
| Condition 3 | 0.35 | 0.5 | B | A | 0.3 | A | A |
| Condition 4 | 0.20 | 1.5 | C | B | 0.5 | B | C |
| Condition 5 | 0.40 | 2.0 | C | B | 0.5 | B | C |
| Condition 6 | 0.00 | 2.0 | C | B | 0.5 | B | C |

According to Table 1, the rolling unevenness was reduced to within the range of 0.3 to 0.5 (μm) from a range before the outer circumferential surface of the coating rod was ground, by setting the closure angle to 0.25° or larger but not larger than 0.35°. As a result, rate B or superior was obtained for scratch evaluation and uneven coating.

On the other hand, if the closure angle was outside the range of 0.25° or larger but not larger than 0.35°, the rolling unevenness was 2 (μm). As a result, rate C was given for scratch evaluation.

Figure 10:
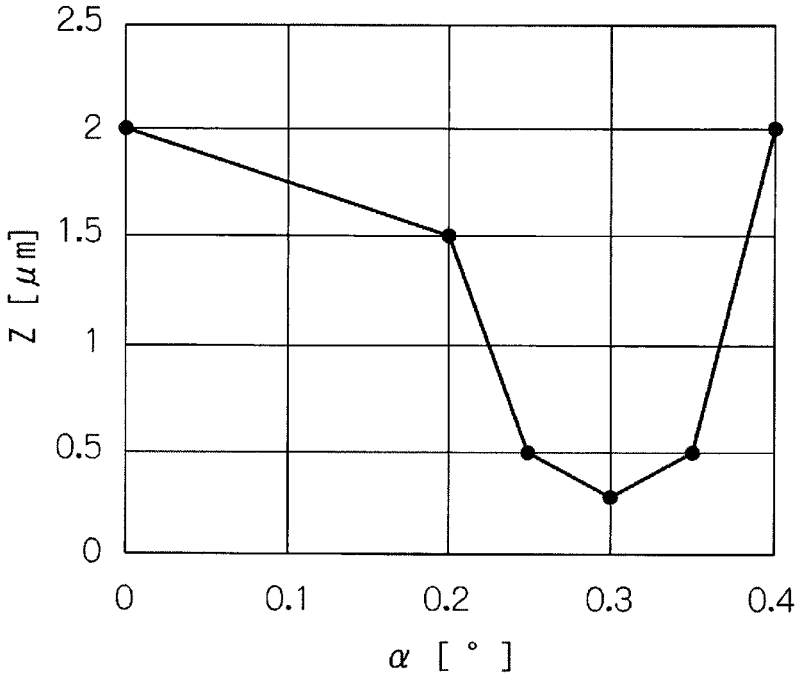
FIG. 10 is a graph showing a relationship between a closure angle and the unevenness of form rolling.

FIG. 10 is a graph showing a relationship between the closure angle α (°) and the form rolling unevenness (μm) before the outer circumferential surface is ground. It can be understood that varying the closure angle reveals that Z has a local minimum value, as shown in the graph of FIG. 10.

By performing a grinding process after form rolling, the scratch evaluation was improved by one rank for Conditions 1 and 3. The scratch evaluation was also improved for Conditions 4 through 6. For Conditions 4 through 6, however, a groove geometry changed locally due to the grinding process, and therefore, a variation in the cross-sectional area of grooves increased. As a result, uneven coating occurred for Conditions 4 through 6.

From the foregoing, the following knowledge was gained.

(1) If the amount of grinding process exceeds a given level, a variation occurs in the cross-sectional area of grooves, thus leading to the occurrence of uneven coating. Accordingly, it can be understood that in order to obtain an excellent coated surface, is it important to control the value of form rolling unevenness (Z) to within a certain range in form rolling.

(2) If the value of form rolling unevenness Z can be controlled to within a certain range in form rolling, effects on the cross-sectional area of grooves due to grinding are reduced. Accordingly, it can be understood that by a grinding process, it is possible to obtain an excellent coated surface condition over an even broader range of conditions.

What is claimed is:

1. A method for manufacturing a coating rod comprising grooves, the method comprising:

preparing a rod material;

disposing a pair of form rolling dies having a plurality of helical convex threads, so that a closure angle formed on an entry side of the rod material by a main axis of each of the form rolling dies and a straight line parallel to an axial direction of the rod material and level with the main axis of each of the form rolling dies is 0.25° or larger, but not larger than 0.35°; and form-rolling the rod material by feeding the rod material along an axial direction thereof and rotating the pair of form rolling dies around the main axes thereof, while clamping the rod material with the pair of form rolling dies, wherein a distance between the first form rolling die and the second form rolling die at the entry side is smaller than an outer diameter of the rod material.

2. The method for manufacturing a coating rod according to claim 1, further comprising a step of grinding a surface of the rod material after the form rolling.

3. The method for manufacturing a coating rod according to claim 1, including holding the rod material by a base in the form rolling step.

4. The method for manufacturing a coating rod according to claim 2, including holding the rod material by a base in the form rolling step.

5. The method for manufacturing a coating rod according to claim 1, including adjusting a distance between the pair of form rolling dies and a heightwise spacing between each of the main axes of the form rolling dies and a central axis of the rod material.

6. The method for manufacturing a coating rod according to claim 2, including adjusting a distance between the pair of form rolling dies and a heightwise spacing between each of the main axes of the form rolling dies and a central axis of the rod material.

7. The method for manufacturing a coating rod according to claim 3, including adjusting a distance between the pair of form rolling dies and a heightwise spacing between each of the main axes of the form rolling dies and a central axis of the rod material.

8. The method for manufacturing a coating rod according to claim 4, including adjusting a distance between the pair of form rolling dies and a heightwise spacing between each of the main axes of the form rolling dies and a central axis of the rod material.

* * * * *